United States Patent [19]

Hayes

[11] Patent Number: 5,024,214

[45] Date of Patent: Jun. 18, 1991

[54] APPARATUS FOR USE IN RELIEVING NECK AND/OR BACK PAIN

[75] Inventor: Leon Hayes, Liverpool, United Kingdom

[73] Assignee: Backeze Limited, Liverpool, United Kingdom

[21] Appl. No.: 350,330

[22] Filed: May 8, 1989

[51] Int. Cl.[5] ..... A61H 1/02

[52] U.S. Cl. ..... 128/75; 128/69; 128/71; 128/68.1; 272/120; 272/121

[58] Field of Search ..... 128/69, 71, 68.1, 75; 272/120, 121

[56] References Cited

U.S. PATENT DOCUMENTS

| | | | |
|---|---|---|---|
| 1,427,004 | 8/1922 | McManis | 128/73 |
| 3,420,229 | 1/1969 | Miller | 128/71 |
| 3,699,953 | 10/1972 | Mason | 128/75 |
| 3,871,366 | 3/1975 | Cotrel | 128/75 |
| 4,466,427 | 8/1084 | Granberg | 128/75 |
| 4,664,101 | 5/1987 | Granberg | 128/71 |

FOREIGN PATENT DOCUMENTS

| | | | |
|---|---|---|---|
| 0121642 | 10/1984 | European Pat. Off. . | |
| 2290184 | 5/1976 | France | 128/75 |
| 208883 | 1/1924 | United Kingdom . | |
| 842855 | 7/1960 | United Kingdom . | |
| 2188551 | 10/1987 | United Kingdom . | |

*Primary Examiner*—V. Millin
*Assistant Examiner*—P. Kubel
*Attorney, Agent, or Firm*—Rogers, Howell & Haferkamp

[57] ABSTRACT

Apparatus for use in relieving neck and/or back pain in the person, is proposed in which the application of force to the spine is controlled by the person and is self-limiting.

The apparatus provides a movable support 10 on which the upper torso of the person rests and a stationary support 18 for the lower torso. A harness co-operable with the person especially the head, and with the movable support member, is subject to a force by way of an actuating line acting through pulleys 24, 28 to give spinal traction in the lower lumber region and in the cervical region.

13 Claims, 1 Drawing Sheet

A
B

APPARATUS FOR USE IN RELIEVING NECK AND/OR BACK PAIN

The present invention relates to apparatus for use in relieving neck and/or back pain.

Neck and back pain are common problem amongst human and the present invention aims to provide apparatus for use in relieving neck and/or back pain, which apparatus is of simple construction and easy to use.

Accordingly, the present invention provides apparatus for use in relieving neck and/or back pain in the person comprising a movable support member for the upper torso, a harness co-operable, in use, with the person preferably the head and preferably secured also to the support member, and means for applying a force to the harness.

The person lies on the movable support member which also preferably has an extension providing a head rest, conveniently adjustable longitudinally. Wheels or roller means is conveniently provided to render the support member movable, with the latter preferably movable on a suitable surface such as a floor, preferably horizontal. A guide track for movement of the support member thereon is optional but by no means essential.

Preferably, a stationary support member is provided on which the lower torso (buttocks) and legs are supported. The support surface of the movable support member and that of the stationary member are preferably in alignment with one another and preferably horizontal. Surface material which provides good frictional contact with the person is to be preferred.

The separation between the movable support member and the stationary support member is usually arranged to occur in the region of the 4/5th lumbar or 5th lumbar/1st sacral vertebrae which are typical problem areas.

The harness is arranged to couple with the person and especially the head of the person to be treated. This may have a collar like coupling so that movement of the movable support member generates a traction on the spine both in the lumbar and cervical regions thereof. The weight of the person on the movable support member together with the movement thereof and the force applied to the head harness generates traction in the aforesaid areas.

More especially the coupling of the harness to the head utilises a fairly standard head harness having strapping embracing on and underneath the jaw bone and around the back of the neck. The head harness is coupled to the movable support member by one or more ropes or wires, say one from each side of the head to each side of the support member. The said ropes pass over a respective pulley located in use further out from the head, bearing in mind the lying position adopted by the person.

The means for applying a force, to the harness conveniently comprises a respective actuating rope or wire each attached to the aforesaid pulley and themselves passing around a further pulley adapted to be fixed to any convenient stationary abutment, provided on a wall or otherwise. The other ends of the actuating ropes, which are adjustable according to arm length, terminate in hand holds for gripping by the person.

With a person lying with the upper torso on the movable support and the remainder of the torso and legs supported on a stationary support, the person pushes on the actuating ropes in a direction towards the feet. This tensions the aforesaid ropes and applies a force to the harness and thereby to both the head and the movable support. Because the movable support is on wheels or the like it is urged to move in response to this force and this movement has the effect also of trying to move with it the upper torso whose weight is carried thereon, whilst the weight of the torso carried on the stationary support resists movement and so a traction is set up in the spine especialy at the junction between the movable and stationary supports, i.e. in the region of the 4/5th lumbar or 5th lumbar/1st sacral vertebrae. The application of force by way of the head harness also contributes to this lumbar traction effect as well as applying traction to the cervical region. Traction in both these places is advantageous in reducing back pain.

If traction is required principally in the cervical region, then the harness can be attached solely to the head, i.e. the connection to the support member is dispensed with.

It will be seen that the person is in complete control of the amount of traction, whilst the maximum force which can be applied is limited to the force required to overcome static friction and generate sliding of the person over the movable and/or stationary support and is determined by body weight. The patient is not physically secured to either of the movable or stationary support members, and the application of force through the head harness with simultaneous lumbar friction avoids any spinal compression, and with particular effectiveness at the point of separtion between the support members.

I find that the aforedescribed apparatus can provide a means of relieving neck and/or back pain to a significant extent and without the need to secure the body to the movable and stationary support members. The traction effect increases the intervertebral disc space, decompressing the disc and easing neurospinal compression. The apparatus may also be used for tensional headaches and spinal spasms by stretching spinal muscles and ligaments.

The traction effect may be light or heavy and is controlled entirely by the patient. The apparatus is easily stored in a small space when not in use.

The present invention will now be described further, by way of example only, with reference to the accompanying drawings; in which.

Figures 1, 2, 3, 4, 5:
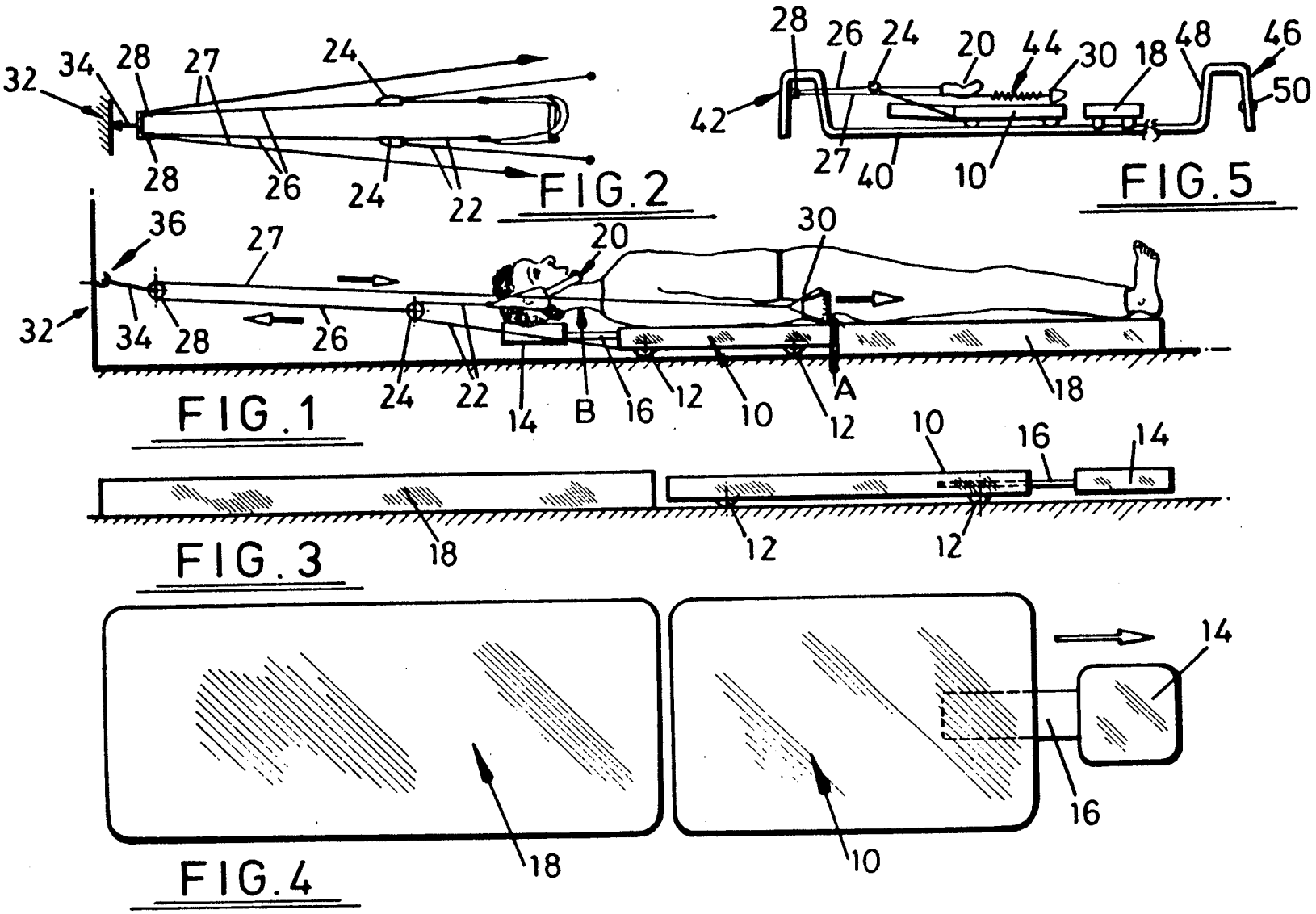
FIG. 1 is a side view of apparatus in use.
FIG. 2 is a plan view of harness of FIG. 1.
FIG. 3 is a side view of support means of the apparatus of FIG. 1.
FIG. 4 is a plan view of the support means of FIG. 3.
FIG. 5 is a side view of another embodiment of apparatus.

Apparatus for use in relieving neck and/or back pain in humans comprises a movable support 10 in the form of a trolley-like device having support wheels or rollers 12, journalled on axles to support the trolley on the ground for movement in a longitudinal direction. The trolley provides a support surface for the upper torso of a human in a lying position such as illustrated. Extending from the torso support and secured adjustably relative thereto is a head rest 14, strut 16 being provided for this purpose. The headrest and/or the support surface of the trolley may be padded/resilient for comfort with the structure being made of any convenient material such as fibreglass, wood or plastics.

In addition to the movable support 10 there is also illustrated a stationary support 18 conveniently arranged as a rectangular platform affording support for the lower body from say the 4/5th lumbar or 5th lumbar/1st sacral vertebrae i.e. buttocks, legs, feet. The platform can be of padded construction or otherwise presenting a resilient surface. The uppermost support surfaces of the supports 10 and 18 are arranged to be in substantial alignment, providing a substantially horizontal surface in use.

The surface of both the movable support 10 and the stationary support 18 is such as to provide good frictional contact with the human laid thereon.

Also illustrated is a harness assembly having a head harness 20 in which the head of the human is received in use and which is coupled to the movable support 10 by wires/ropes 22. In the illustration two wires/ropes 22 are provided, one for each side of the harness and each passes around a respective pulley 24 which is attached to the end of a respective rope/wire 26 which itself passes around a pulley 28 and whose other end 27 terminates in a hand hold 30. The two pullies 28 in use are secured to any convenient fixed point such as a walk 32 in the illustration by way of wire/rope 34, say attaching to hook 36.

The arrangement of the apparatus is such that pulling on the wire/rope ends 27 say by way of handle 30 causes a force to be applied to the wire/rope 22 and thence to the harness and also the movable trolley 10. The upper torso is thus moved towards the fixed point and more especially away from the stationary support 18 so that traction is applied to the spine, especially in the region of the 4th/5th lumbar or 5th lumbar/ 1st sacral vertebrae where separation of the support occurs—see arrow A and also in the cervical area—see arrow B.

Reference is now made to FIG. 5 in which there is illustrated another embodiment of apparatus. Parts corresponding to those used in the above described embodiment are identified with the same reference numerals. The movable support member 10 is shown with wheels 12 which run on a track 40 comprising two parallel spaced members only one of which is visible in the side view. The tracks are linked by cross members at spaced intervals along the length thereof. The head end of the track indicated at 42 is arranged to provide an abutment 36' for the pulley or pullies 28 of the harness lines 26, 27. A convenient arrangement of harness is provided by a single length of line extending from the left hand hold to the right hand hold by way of two pullies secured with respect to the abutment end 42, and passing by way of a common pulley at 24. The chin harness is shown at 20. Interpassed in line 27 immediately adjacent each hand hold 30 is an optional tension spring shown at 44 which serve to limit application pressure by way of the handles 30. The stationary support member 18 is conveniently secured adjustably to the track 40 by inserting brackets 46 and supports the lower torso (buttocks) with legs extending therebeyond. The foot end of the track 46 may be extended and arranged to provide a padded foot restraint as a crossbar 48, also an optional foot rest 50.

In operation, the patient lies on the movable and stationary support members so as to position the area for treatment, 4th/5th lumbar or 5th lumbar/1st sacral vertebrae where separation of the support occurs—see arrow A. The harness is fitted under the chin of the patient and force applied to the harness as previously described by the hand holds 30. This applies a traction force both to the head by way of the chin harness and to the movable support member as previously described. By fitting the pulley 28 to the guide track the apparatus becomes self contained. The foot rest affords the opportunity to increase the traction effect beyond that limited by sliding friction of the body with the stationary member, by hooking the feet behind the crossbar 48. However, this is completely patient controlled—with no fixing of foot to bar, so that release is readily possible before excessive traction is applied.

I claim:

1. Apparatus for use in relieving neck and/or back pain in the person comprising a single movable support member on which the upper torso rests in use, and stationary support means next adjacent said support member on which the lower torso (buttocks) rests in use, a harness co-operable, in use, with the person and also secured to the movable support member, the apparatus further comprising a pulley adapted to be mounted on a stationary abutment, and means for applying a force to the harness which force it to act in use in a direction to urge the body and the movable support member in one and the same direction away from the stationary support means, which force applying means comprises at least one actuating line to which force is applied by the person through the arms thereof, in an opposite direction and which acts through said pulley to apply said force to the body and the movable support members.

2. Apparatus according to claim 1 in which the stationary support means also supports the legs of the person.

3. Apparatus according to claim 1 in which the movable support member and the stationary support means are in alignment with one another longitudinally and horizontally.

4. Apparatus according to claim 1 in which the harness is configured as a head harness to couple with the head of the person using a head harness.

5. Apparatus according to claim 4 in which the head harness is coupled to the movable support member by two lines and wherein said lines pass over respective pulley means which is acted on by said actuating lines.

6. Apparatus according to claim 1 in which the pulley is adapted to be mounted to a wall.

7. Apparatus according to claim 1 in which the movable support member has an extension providing a head rest.

8. Apparatus according to claim 7 in which the head rest is adjustable longitudinally.

9. Apparatus as claimed according to claim 1 in which the movable support member is provided with wheels or rollers to render it movable in the longitudinal direction of the person, on a suitable surface, such as a horizontal floor.

10. Apparatus according to claim 1 in which the support member is guided for movement on a track.

11. Apparatus as claimed in claim 10 in which the guide track is extended to the head end to provide said stationary abutment.

12. Apparatus as claimed in claim 10 in which the guide track is extended to the foot end to provide a foot restraint.

13. Apparatus as claimed in claim 1 in which a surface covering having a good frictional contact with the person is employed for at least one of the movable support member and the stationary support member.

* * * * *